US011732591B2

(12) United States Patent
Kubo et al.

(10) Patent No.: US 11,732,591 B2
(45) Date of Patent: Aug. 22, 2023

(54) FILM COOLING STRUCTURE AND TURBINE BLADE FOR GAS TURBINE ENGINE

(71) Applicant: IHI Corporation, Tokyo (JP)

(72) Inventors: Seiji Kubo, Tokyo (JP); Hitoshi Hattori, Tokyo (JP); Yoji Okita, Tokyo (JP); Shu Fujimoto, Tokyo (JP); Ryo Ikehara, Tokyo (JP)

(73) Assignee: IHI Corporation, Tokyo (JP)

( * ) Notice: Subject to any disclaimer, the term of this patent is extended or adjusted under 35 U.S.C. 154(b) by 134 days.

(21) Appl. No.: 17/449,316

(22) Filed: Sep. 29, 2021

(65) Prior Publication Data

US 2022/0018261 A1 Jan. 20, 2022

Related U.S. Application Data

(63) Continuation of application No. PCT/JP2020/020550, filed on May 25, 2020.

(30) Foreign Application Priority Data

Jun. 7, 2019 (JP) ..... 2019-107005

(51) Int. Cl.
*F01D 5/18* (2006.01)

(52) U.S. Cl.
CPC ..... *F01D 5/186* (2013.01); *F05D 2250/711* (2013.01); *F05D 2260/202* (2013.01)

(58) Field of Classification Search
CPC ..... F01D 5/186; F05D 2260/202; F05D 2250/0323; F05D 2250/324
See application file for complete search history.

(56) References Cited

U.S. PATENT DOCUMENTS 10,760,431 B2 * 9/2020 Webster ..... F01D 25/12
2008/0031738 A1 2/2008 Lee
(Continued)

FOREIGN PATENT DOCUMENTS

GB 2 389 330 A 12/2003
JP 2006-242187 A 9/2006
(Continued)

OTHER PUBLICATIONS

Extended European Search Report dated Oct. 31, 2022 in European Patent Application No. 20819223.7, 8 pages.
(Continued)

*Primary Examiner* — Eldon T Brockman
(74) *Attorney, Agent, or Firm* — Oblon, McClelland, Maier & Neustadt, L.L.P.

(57) ABSTRACT

The film cooling structure includes a wall part extending forward and rearward, and a cooling hole including a tubular inner peripheral surface and inclined such that an outlet is positioned rearward of an inlet. The cooling hole includes a throat having a minimum cross section, and a diffuser part extending from the throat to the outlet. The diffuser part includes a channel cross section expanding rearward and along the wall part as it approaches the outlet. The inner peripheral surface of the cooling hole includes a flat portion extending in a direction perpendicular to the cooling hole and along the wall part at a front part of the inner peripheral surface, and a convex portion projecting from a rear part of the inner peripheral surface toward the flat portion, extending in parallel with the flat portion, and forming the throat between the flat portion and the convex portion.

3 Claims, 4 Drawing Sheets

(56) References Cited

U.S. PATENT DOCUMENTS

| | | | | |
|---|---|---|---|---|
| 2010/0239412 | A1 | 9/2010 | Draper | |
| 2013/0209229 | A1 | 8/2013 | Xu et al. | |
| 2014/0271229 | A1 | 9/2014 | Nita et al. | |
| 2016/0008889 | A1 | 1/2016 | Xu | |
| 2016/0153283 | A1* | 6/2016 | Xu | F01D 5/186 415/115 |
| 2016/0201474 | A1 | 7/2016 | Slavens et al. | |
| 2019/0071977 | A1* | 3/2019 | Webster | F01D 9/02 |
| 2020/0070250 | A1 | 3/2020 | Xu | |

FOREIGN PATENT DOCUMENTS

| | | | |
|---|---|---|---|
| JP | 2013-124612 | A | 6/2013 |
| JP | 5600449 | B2 | 10/2014 |
| JP | 2016-519236 | A | 6/2016 |
| WO | WO 2013/089255 | A1 | 6/2013 |

OTHER PUBLICATIONS

Decision to Grant dated Feb. 14, 2023 in Japanese Patent Application 2021-524767, 1 page.
International Search Report dated Aug. 11, 2020 in PCT/JP2020/020550 filed May 25, 2020, 2 pages.

* cited by examiner

FILM COOLING STRUCTURE AND TURBINE BLADE FOR GAS TURBINE ENGINE

CROSS REFERENCE TO RELATED APPLICATIONS

This application is a continuation application of International Application No. PCT/JP2020/020550, now WO2020/246289, filed on May 25, 2020, which claims priority to Japanese Patent Application No. 2019-107005, filed on Jun. 7, 2019, the entire contents of which are incorporated by reference herein.

BACKGROUND

1. Technical Field

The present disclosure relates to a film cooling structure and a turbine blade for a gas turbine engine.

2. Description of the Related Art

A turbine of a gas turbine engine includes turbine blades that constitute stator vanes and turbine blades. The turbine blades are exposed to combustion gas from the combustor. To prevent thermal damage due to the combustion gas, a number of film cooling holes are formed on an airfoil surface of each turbine blade (see Japanese Patent No. 5600449 and Japanese Patent Laid-Open Application Publication No. 2013-124612).

SUMMARY

To improve the efficiency of the gas turbine engine, it is important to increase the temperature of combustion gas (combustion temperature). With the increase of combustion temperature, further improvement is required in the cooling efficiency of the turbine blade.

The present disclosure has been made with the above consideration, is objected to provide a film cooling structure and a turbine blade for a gas turbine engine, which are capable of improving cooling efficiency.

A first aspect of the present disclosure is a film cooling structure including: a wall part having an outer surface and an inner surface and extending forward and rearward; and a cooling hole including an inner peripheral surface formed in a tubular shape, the inner peripheral surface forming an inlet opening to the inner surface and an outlet opening to the outer surface, the cooling hole penetrating through the wall part and being inclined such that the outlet is positioned rearward of the inlet; wherein the cooling hole includes: a throat having a minimum cross section; and a diffuser part extending from the throat to the outlet and including a channel cross section expanding rearward and along the wall part as the channel cross section approaches the outlet, and the inner peripheral surface of the cooling hole includes: a flat portion at a front part of the inner peripheral surface, extending in a direction which is perpendicular to an extending direction of the cooling hole and is along the wall part; and a convex portion projecting from a rear part of the inner peripheral surface toward the flat portion, extending in parallel with the flat portion, and forming the throat between the convex portion and the flat portion.

A front surface of the inner peripheral surface of the cooling hole in the diffuser part may include a convex portion projecting rearward and extending to the outlet.

A second aspect of the present disclosure is a turbine blade for a gas turbine engine including the film cooling structure according to the first aspect of the present disclosure.

The present disclosure can provide a film cooling structure and a turbine blade for a gas turbine engine, which are capable of improving cooling efficiency.

BRIEF DESCRIPTION OF THE DRAWINGS

FIG. 5A is a diagram showing a schematic example of the velocity distribution at the throat, and FIG. 5B is a diagram showing a schematic example of the velocity distribution in the diffuser part.

DESCRIPTION OF THE EMBODIMENTS

Figure 1:
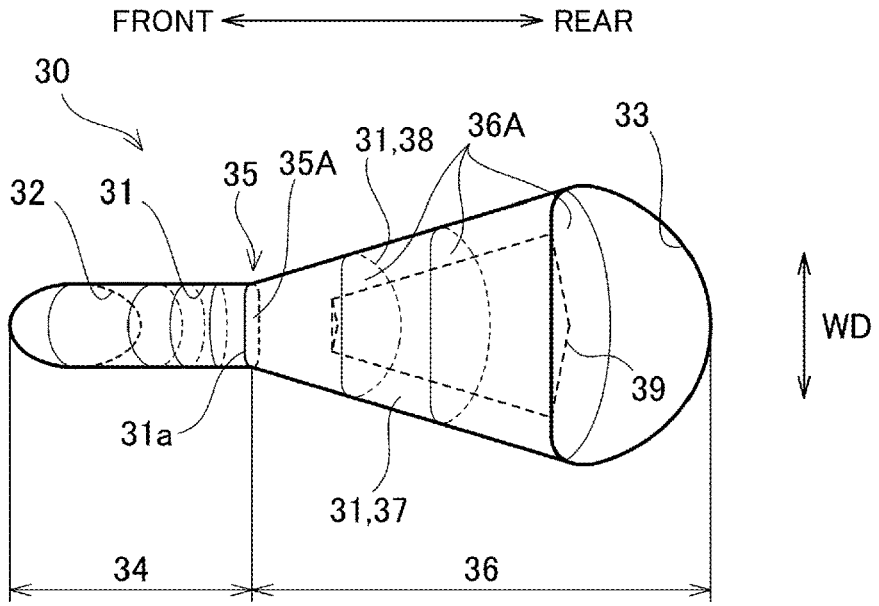
FIG. 1 is a top view illustrating a cooling hole according to an embodiment of the present disclosure.

Embodiments of the present disclosure will be described with reference to the drawings. Components common in respective drawings are denoted by the same reference numerals, and the description to be duplicated thereof will be omitted.

The film cooling structure according to the present embodiment is provided on a structure exposed to a high-temperature heat medium (for example, combustion gas). The structure may be, for example, a turbine blade (rotor blade and stator vane) of a gas turbine engine (not shown), a combustor liner, a nozzle of a rocket engine, or the like. A large number of cooling holes are formed in a wall part of the structure. The cooling holes constitute a film cooling structure together with the wall part. The cooling medium CG (e.g., air) flowing out of the cooling holes forms a heat insulating layer on the wall part to protect the structure from the heat medium. Hereinafter, for convenience of explanation, the upstream side in the flow direction of the heat medium HG is defined as "forward (front)" and the downstream side in the flow direction of the heat medium HG is defined as "rearward (rear)".

Figure 2:
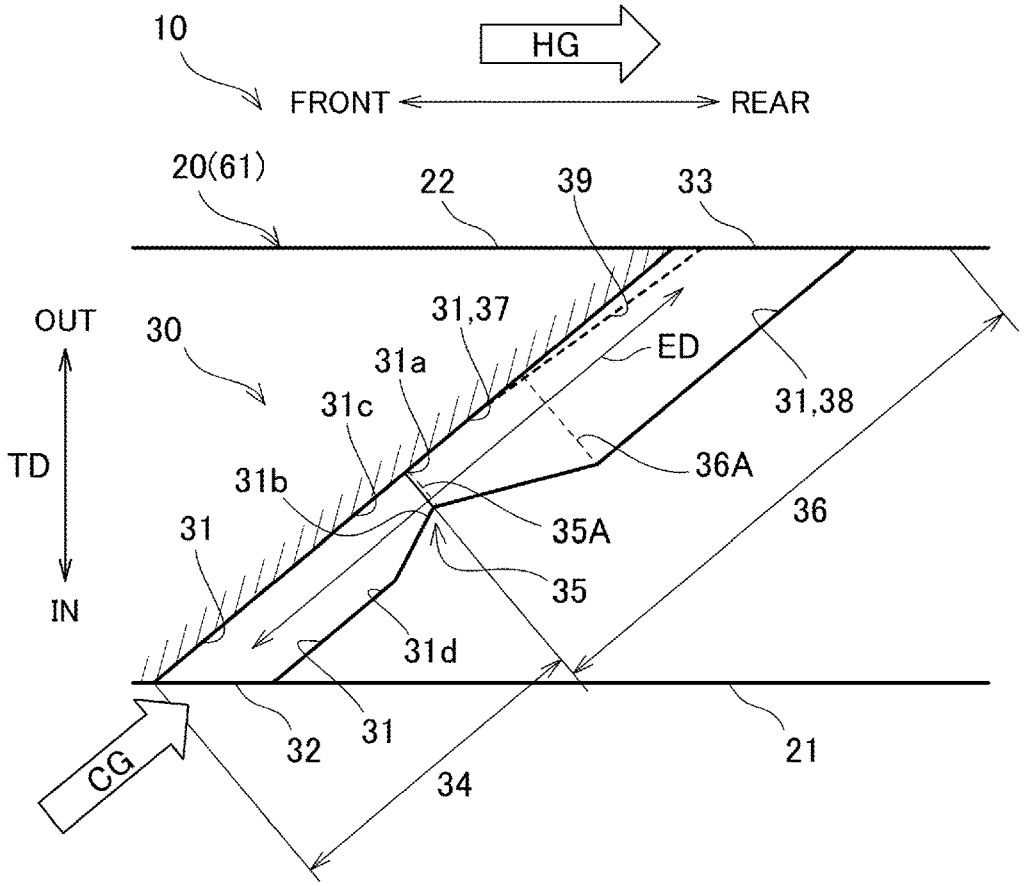
FIG. 2 is a cross-sectional view illustrating a film cooling structure according to an embodiment of the present disclosure.
Figure 3:
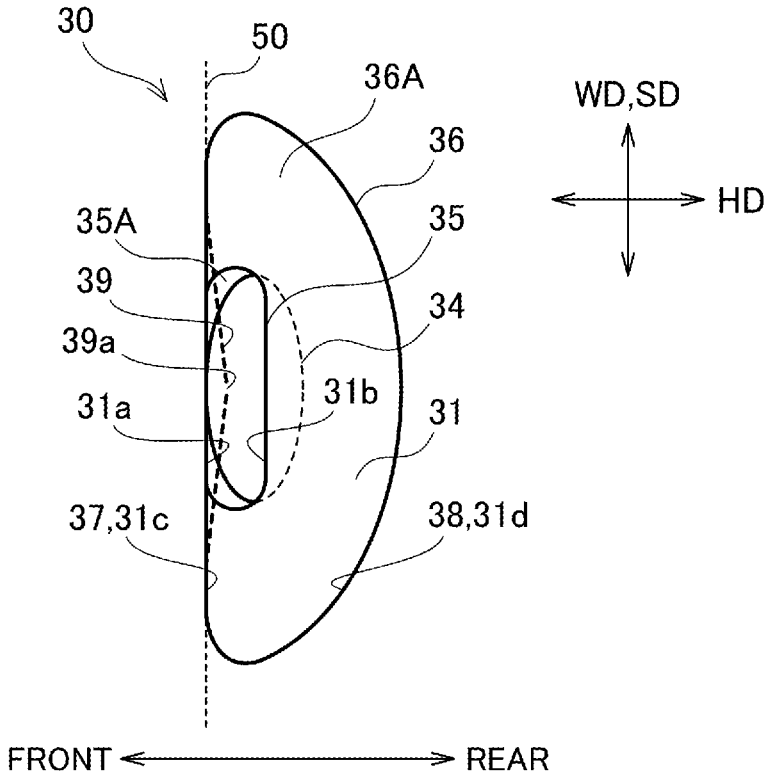
FIG. 3 is a diagram illustrating the cooling hole viewed from an outlet side of the cooling hole along an extending direction of the cooling hole.

FIG. 1 is a top view illustrating a cooling hole 30 in the film cooling structure 10 according to the present embodiment. FIG. 2 is a cross-sectional view illustrating a film cooling structure 10 according to the present embodiment. FIG. 3 is a diagram illustrating the cooling hole 30 viewed from an outlet side of the cooling hole 30 along an extending direction ED of the cooling holes 30. For convenience of explanation, a direction perpendicular to the extending direction ED of the cooling hole and along a wall part 20 will be referred to as a width direction WD. A direction perpendicular to the extending direction ED and the width direction WD of the cooling hole 30 is referred to as a height direction HD. Further, A length in the width direction WD is referred to as "width". The length in the height direction HD is referred to as "height".

As shown in FIG. 2, the film cooling structure 10 includes a wall part 20 and a cooling hole (cooling channel) 30. The wall part 20 has an inner surface 21 and an outer surface 22, and extends forward and rearward. The outer surface 22 is exposed to the heating medium HG. On the other hand, the inner surface 21 faces a cooling medium CG which is applied by a predetermined pressure. The material of the wall part 20 may be a known heat-resistant alloy.

The cooling hole 30 is a channel for the cooling medium CG, and has an inner peripheral surface 31 extending with a tubular shape. The cooling hole 30 includes an inlet 32 opening to the inner surface 21 of the wall part 20 and an outlet 33 opening to the outer surface 22 of the wall part 20. That is, the tubular inner peripheral surface 31 forms the inlet 32 that opens to the inner surface 21 and the outlet 33 that opens to the outer surface 22.

The cooling hole 30 penetrates through the wall part 20, and is inclined such that the outlet 33 is positioned rearward of the inlet 32. In other words, the cooling holes 30 extend from the inner surface 21 to the outer surface 22 at an angle inclined toward a flow direction of the heat medium HG with respect to a thickness direction TD of the wall part 20. The cooling medium CG flows into the inlet 32 of the cooling hole 30 and flows out from the outlet 33 of the cooling hole 30.

As shown in FIGS. 1 and 2, the cooling holes 30 include a straight-tube part 34, a throat 35, and a diffuser part 36. The straight-tube part 34 has the inlet 32 of the cooling hole 30. The straight-tube part 34 extends from the inlet 32 toward the diffuser part 36, and is connected (communicated) to the diffuser part 36 through the throat 35. The straight-tube part 34 has a channel cross section formed in an elliptical shape or a forward curved semicircular shape. The channel cross section of the straight-tube part 34 may be a polygon such as a triangle, a rectangle or the like. In any cases, the channel cross section of the straight-tube part 34 gradually changes to a flat shape along the wall part 20 such that it becomes close to a channel cross section (cross section) of the throat 35 as it approaches the throat 35 described later.

The throat 35 is a flow path (constricted portion or narrowed portion) having a channel cross section 35A which is the minimum cross section of the cooling hole 30. The channel cross section 35A is flat along the wall part 20. That is, the width of the throat 35 is sufficiently larger than the height of the throat 35. The cross sectional area described herein is an area of a cross section orthogonal to the extending direction ED of the cooling hole 30. The width of the throat 35 may be equal to or greater than the width of the straight-tube part 34. In either case, the width of the throat 35 is equal to the minimum width of the diffuser part 36.

The diffuser part 36 extends from the throat 35 to the outlet 33. The diffuser part 36 includes a channel cross section 36A. The channel cross section 36A expands rearward and along the wall part 20 (i.e., in the width direction WD) as it approaches the outlet 33. For example, as shown in FIG. 3, the channel cross section 36A is formed in a flat semicircular shape along the wall part 20. In this case, the diffuser part 36 has a flat surface 37 and a curved surface 38 both as an inner peripheral surface 31 forming a semicircular channel cross section 36A. The flat surface 37 is positioned forward of the curved surface 38 and extends in the width direction. On the other hand, the curved surface 38 is located rearward of the flat surface 37 and curved rearward. That is, the flat surface 37 is a chord on an outer edge of the aforementioned semicircular cross section, and the curved surface 38 is an arc on the outer edge. However, as described later, this "chord" is not limited to a straight line as described later. Note that the flat surface 37 and the curved surface 38 are integrally (continuously) formed via minute curved surfaces (i.e., fillets) for smoothly connecting between these two.

As shown in FIGS. 1 and 3, the width of the channel cross section 36A of the diffuser part 36 increases as it approaches the outlet 33. As shown in FIG. 3, the height of the channel cross section 36A also increases as it approaches the outlet 33. However, the height of the channel cross section 36A increases more rearward than forward as it approaches the outlet 33 based on the position of the channel cross section 35A of the throat 35 as viewed from the extending direction of the cooling hole 30.

As shown in FIGS. 2 and 3, the inner peripheral surface 31 of the cooling hole 30 includes a flat portion 31*a* and a convex portion (first convex portion) 31*b*. The flat portion 31*a* is a flat surface formed in a belt-like shape extending in the width direction WD at a front part 31*c* of the inner peripheral surface 31. The flat portion 31*a* can have any length in the extending direction ED of the cooling hole 31 as long as the flat portion 31*a* at least faces the top of the convex portion 31*b* closest to the flat portion 31*a*.

The convex portion 31*b* forms the throat 35 between the convex portion 31*b* and the flat portion 31*a*, the throat 35 having the channel cross section 35A with a minimum area. In other words, the convex portion 31*b* and the flat portion 31*a* constitute the throat 35 having the channel cross section 35A with a minimum area therebetween. The convex portion 31*b* protrudes from the rear part 31*d* of the inner peripheral surface 31 toward the flat portion 31*a* and extends in parallel with the flat portion 31*a*. The top of the convex portion 31*b* is separated from the flat portion 31*a* by a predetermined distance in the height direction HD to form the throat 35 as described above. In other words, the flat portion 31*a* and the convex portion 31*b* are provided at positions where the throat 35 is formed on the inner peripheral surface 31.

As shown in FIG. 3, of the inner peripheral surface 31 in the straight-tube part 34, the throat 35, and the diffuser part 36, the most forward portions (e.g., the flat portion 31*a* in the throat 35) are positioned at the same position (height, level) in the height direction HD as seen from the extending direction ED of the cooling hole 30. For example, each of the straight-tube part 34, the throat 35, and the diffuser part 36 may be in contact with a virtual surface 50 extending in the extending direction ED and the width direction WD of the cooling hole 30 on their front side.

Figure 4:
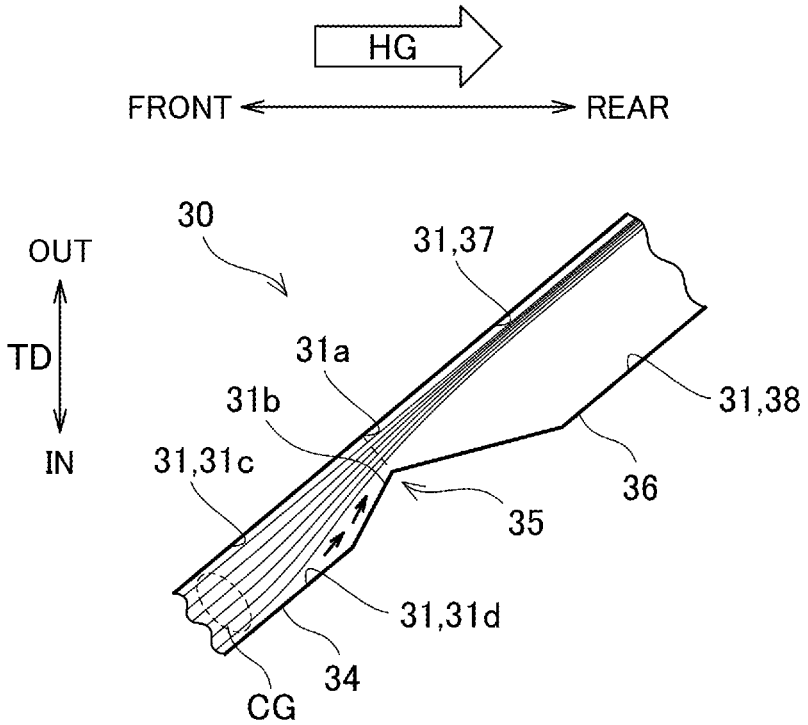
FIG. 4 is a diagram illustrating a flow of the cooling medium through the cooling hole.
Figure 5A:
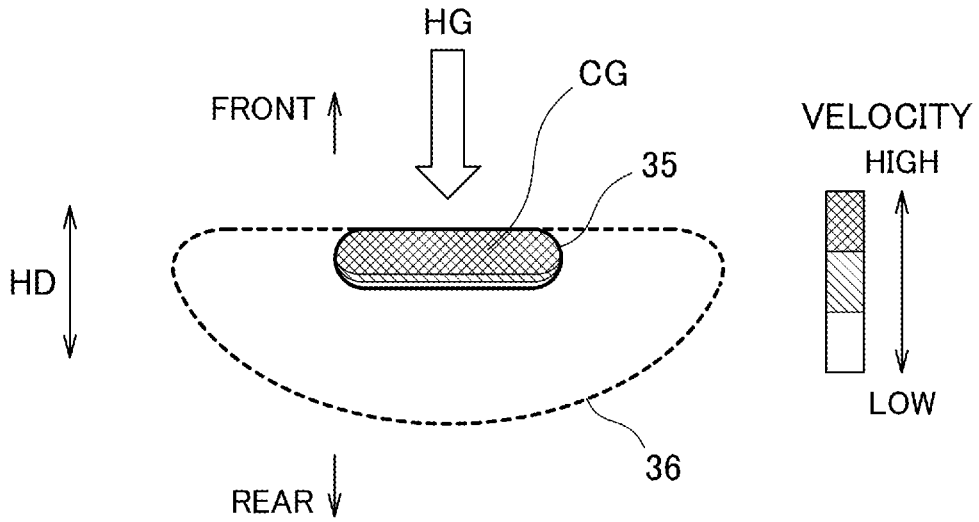
FIGS. 5A and 5B are diagrams for explaining the velocity distribution of the flow of the cooling medium in the cooling hole.
Figure 5B:
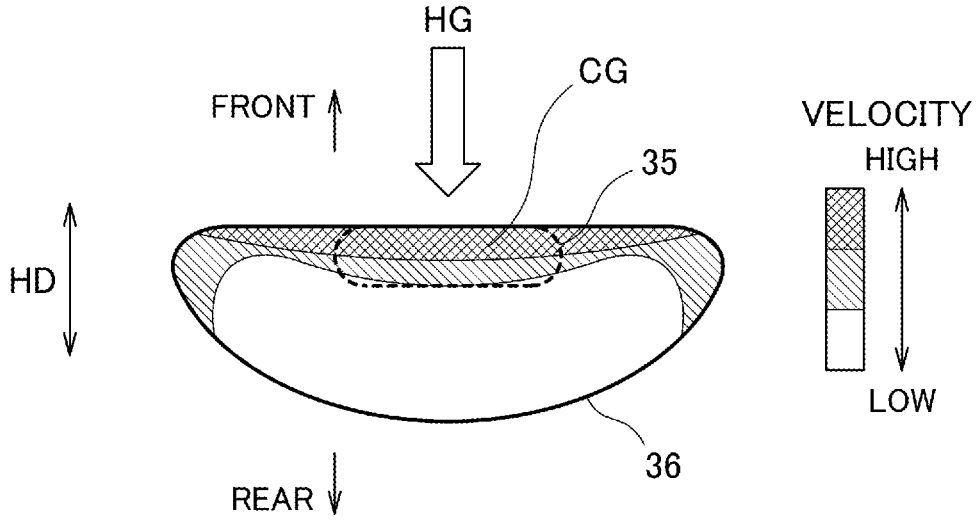

FIG. 4 illustrates the flow of the cooling medium CG in the cooling hole 30. FIG. 4 shows the main stream of the cooling medium CG by solid lines. FIGS. 5A and 5B are diagrams for explaining the velocity distribution of the flow of the cooling medium CG in the cooling hole 30. FIG. 5A is a diagram showing a schematic example of the velocity distribution in the throat 35. FIG. 5B is a diagram showing a schematic example of the velocity distribution in the diffuser part 36.

As shown in FIG. 4, the main stream of the cooling medium CG flows from the straight-tube part 34 toward the diffuser part 36. Here, it should be noted that the convex portion 31*b* is provided on the upstream side (near the inlet 32) of the diffuser part 36 to form the throat 35. As described above, the convex portion 31*b* protrudes from the rear part 31*d* of the inner peripheral surface 31 toward the front part 31*c* of the inner peripheral surface 31. Accordingly, the convex portion 31*b* deflects the main stream of the cooling medium CG forward (i.e., toward the front part 31*c* or the flat portion 31*a*).

The convex portion 31*b* forms the throat 35 together with the flat portion 31*a* of the inner peripheral surface 31. The area of the cross section of the cooling hole 30 is minimized at the throat 35. The channel cross section 35A of the throat 35 has a flat shape along the width direction WD. Therefore, the main stream of the cooling medium CG is accelerated while being compressed toward the throat 35.

Even after passing through the throat 35, the flow of the cooling medium CG flows to the outlet 33 in a forward biased state. On the other hand, the flow path of the cooling hole 30 is expanded in the width direction WD in the diffuser part 36. Therefore, the main stream of the cooling medium CG expands in the width direction in a state where it is unevenly distributed forward, and flows out from the outlet 33.

As described above, the main stream of the cooling medium CG is accelerated while being compressed forward. This reduces the velocity difference between the accelerated cooling medium CG and the main stream of the heat medium HG. Consequently, it is possible to suppress an aerodynamic loss (pressure loss) caused by mixing of the cooling medium CG and the heating medium HG when the cooling medium CG flows out of the outlet 33 of the cooling hole 30.

The main stream of the cooling medium CG is expanded (dispersed) in the width direction WD by the diffuser part 36. Therefore, the film cooling can be widely performed with suppressing the aerodynamic loss. That is, the cooling efficiency with the cooling medium CG can be improved.

As shown by dotted lines in FIGS. 1 to 3, a front surface (the front part 31*c*, e.g., the flat surface 37) of the inner peripheral surface 31 of the cooling hole 30 in the diffuser part 36 may include a convex portion (second convex portion) 39. The convex portion 39 projects rearward and extends to the outlet 33. The width of the convex portion 39 may be constant along the extending direction ED or may increase as it approaches the outlet 33. The convex portion 39 includes a top 39*a* projecting rearmost. As shown in FIG. 3, the top 39*a* may be located at the center of the diffuser part 36 in the width direction WD. In any cases, the convex portion 39 partially blocks the throat 35 when viewed from the extending direction ED of the cooling hole 30. Accordingly, the convex portion 39 promotes the widthwise expansion of the main stream, which is unevenly distributed forward, of the cooling medium CG by the diffuser part 36. With the promotion of the expansion, the area of film cooling can be enlarged in the width direction WD.

Figure 6:
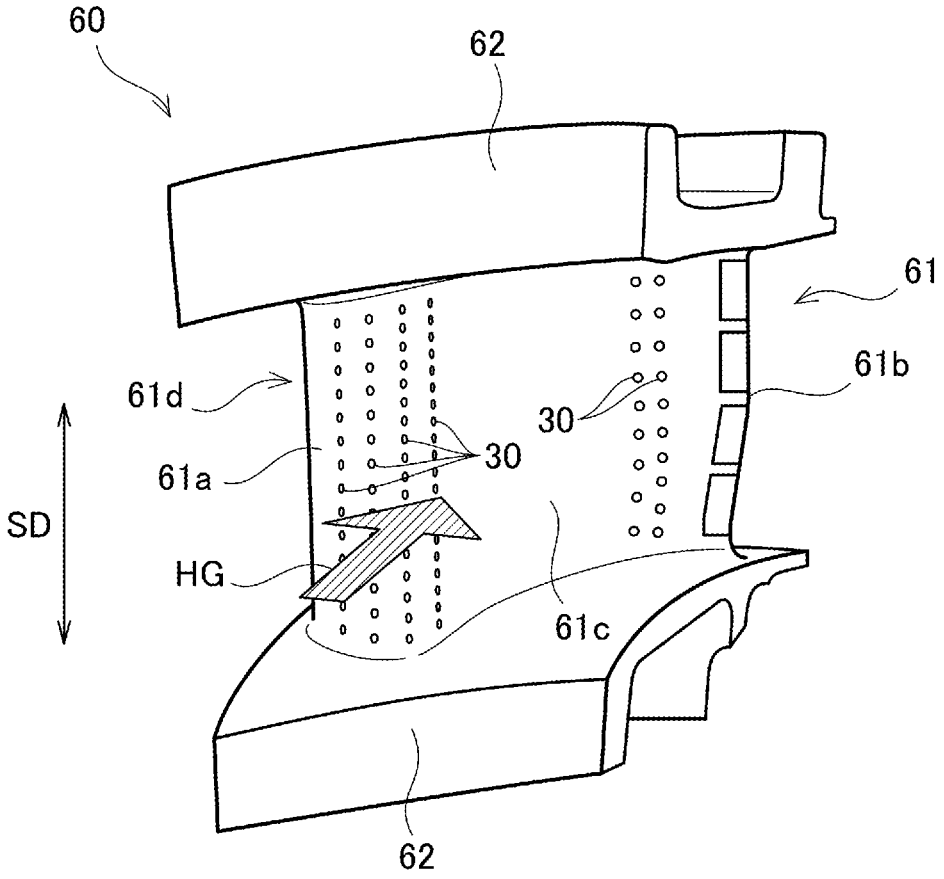
FIG. 6 is a perspective view showing a schematic configuration of a turbine blade (stationary blade) according to an embodiment of the present disclosure.

The film cooling structure 10 according to the present embodiment can be applied to a turbine blade for a gas turbine engine. FIG. 6 is a perspective view illustrating a schematic configuration of the turbine blade (stator vane 60). The stator vane 60 together with a rotor blade (not shown) constitute a turbine (not shown) of a gas turbine engine (not shown). The film cooling structure 10 can also be applied to the rotor blade (not shown) which is the turbine blade constituting the turbine (not shown).

FIG. 6 is a perspective view illustrating a schematic configuration of the stator vane 60. As shown in this figure, the stator vane 60 includes an airfoil 61, bands 62, and cooling holes 30. The airfoil 61 is provided on the downstream side of a combustor (not shown) which discharges the combustion gas as the aforementioned heating medium HG. That is, the airfoil 61 is located in a flow path of the combustion gas.

The airfoil 61 has a leading edge 61*a*, a trailing edge 61*b*, a pressure surface (pressure side) 61*c*, and a suction surface (suction side) 61*d*. Combustion gas as the heating medium HG flows in the direction from the leading edge 61*a* to the trailing edge 61*b* along the pressure surface 61*c* and the suction surface 61*d*.

The airfoil 61 is provided with an internal space (cavity or cooling channel (not shown)) into which cooling air as a cooling medium CG is introduced. The cooling air is extracted from a compressor (not shown), for example. The bands 62 are provided to sandwich the airfoil 61 in a span direction SD of the airfoil 61. The bands 62 function as a part of a wall of the flow path of the combustion gas (i.e., endwalls, platforms or shrouds). These bands 62 are integrated with the tip and the hub of the airfoil 61.

In this embodiment, the film cooling structure 10 is applied to at least one of the pressure surface 61*c* and the suction surface 61*d* of the airfoil 61. That is, at least one of the pressure surface 61*c* and the suction surface 61*d* of the airfoil 61 functions as the wall part 20 of the film cooling structure 10, and the cooling holes 30 are formed therein. Hereinafter, for convenience of explanation, an example in which the film cooling structure 10 is provided on the pressure surface 61*c* will be described.

The cooling hole 30 is formed on the pressure surface 61*c*. The cooling hole 30 is inclined such that the outlet 33 is positioned closer to the trailing edge 61*b* than the inlet 32. The flat surface 37 of the diffuser part 36 extends in the extending direction ED of the cooling hole 30 and in the span direction SD of the airfoil 61.

In the pressure surface 61*c*, the main stream of the combustion gas flows in a direction from the leading edge 61*a* toward the trailing edge 61*b*. On the other hand, the cooling air, which has been introduced into the airfoil 61, flows into the inlet 32 of the cooling hole 30 and flows out of the outlet 33. The cooling air, which has flown out of the outlet 33, flows downstream while merging with the main stream of the combustion gas. While exiting the outlet 33, the cooling air is expanded in the span direction SD. Therefore, the cooling area on the pressure surface 61*c* can be extended in the span direction SD.

In addition, the cooling air is accelerated until it flows out of the outlet 33. Thus, the speed difference between the main stream of the cooling air and the main stream of the combustion gas is reduced, thereby aerodynamic loss can be suppressed. That is, it is possible to provide a turbine blade capable of performing film cooling of a wide area while suppressing aerodynamic loss.

It should be noted that the present disclosure is not limited to the embodiments described above, but is indicated by the description of the claims and further includes all modifications within the meaning and scope of the description of the claims.

What is claimed is:

1. A film cooling structure comprising:

a wall part having an outer surface and an inner surface and extending forward and rearward; and a cooling hole including an inner peripheral surface formed in a tubular shape, the inner peripheral surface forming an inlet opening to the inner surface and an outlet opening to the outer surface, the cooling hole penetrating through the wall part and being inclined such that the outlet is positioned rearward of the inlet; wherein the cooling hole includes:

a throat having a minimum cross section; and a diffuser part extending from the throat to the outlet and including a channel cross section expanding rearward and along the wall part as the channel cross section approaches the outlet, and the inner peripheral surface of the cooling hole includes:

a flat portion at a front part of the inner peripheral surface, extending in a direction which is perpendicular to an extending direction of the cooling hole and is along the wall part; and a convex portion projecting from a rear part of the inner peripheral surface toward the flat portion, extending in parallel with the flat portion, and forming the throat between the convex portion and the flat portion.

2. The film cooling structure according to claim 1, wherein a front surface of the inner peripheral surface of the cooling hole in the diffuser part includes a convex portion projecting rearward and extending to the outlet.

3. A turbine blade for a gas turbine engine comprising the film cooling structure according to claim 1.

* * * * *